US006293539B1

(12) United States Patent
Fukatsu et al.

(10) Patent No.: US 6,293,539 B1
(45) Date of Patent: Sep. 25, 2001

(54) ROTATING OR PIVOTING APPARATUS AND MEDIUM FEEDING APPARATUS

(75) Inventors: Kunio Fukatsu, Yokohama; Masao Obama, Yokosuka; Katsumi Inoue, Sendai, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/516,772

(22) Filed: Mar. 1, 2000

(30) Foreign Application Priority Data

Jun. 2, 1999 (JP) ..... 11-155136

(51) Int. Cl.[7] ..... B65H 1/08

(52) U.S. Cl. ..... 271/126; 110/120; 110/152; 110/153; 110/154; 110/155; 73/650; 73/65.07; 310/311; 310/313 A

(58) Field of Search ..... 271/120, 126, 271/110, 152, 153, 154, 155; 73/650, 65.07; 310/311, 313 A

(56) References Cited

U.S. PATENT DOCUMENTS

| | | | | |
|---|---|---|---|---|
| 3,590,289 | * | 6/1971 | Ostwald | 310/8.4 |
| 4,353,199 | * | 10/1982 | Chow et al. | 56/10.2 |
| 4,453,103 | * | 6/1984 | Vishnevsky et al. | 310/323 |
| 5,144,187 | * | 9/1992 | Culp | 310/328 |
| 6,218,749 | * | 4/2001 | Nondahl et al. | 310/68 |
| 6,232,700 | * | 5/2001 | Kosaka et al. | 310/323.17 |
| 6,237,428 | * | 5/2001 | Odachi et al. | 73/862.333 |

* cited by examiner

*Primary Examiner*—Joseph E. Valenza
*Assistant Examiner*—Richard Ridles
(74) *Attorney, Agent, or Firm*—Pillsbury Winthrop LLP

(57) ABSTRACT

A medium feeding apparatus comprises a driving motor for moving a backup plate to press a medium against a pickup roller, piezoelectric elements for sensing slippage between the pickup roller and the medium which occurs while the roller rotates, and a controller for driving the driving motor to thereby vary a force for pressing the medium against the pickup roller, when the sensing means has sensed slippage between the pickup roller and the medium.

11 Claims, 6 Drawing Sheets

ROTATING OR PIVOTING APPARATUS AND MEDIUM FEEDING APPARATUS

CROSS-REFERENCE TO RELATED APPLICATION

This application is based upon and claims the benefit of priority from the prior Japanese Patent Application No. 11-155136, filed Jun. 2, 1999, the entire contents of which are incorporated herein by reference.

BACKGROUND OF THE INVENTION

This invention relates to a rotating or pivoting apparatus for use in, for example, a copy machine for picking up and transferring a medium such as a copy paper sheet.

There is a medium feeding apparatus for use in, for example, a copy machine, in which sheets of a medium are stacked on a backup plate, and picked up one by one in the order beginning from an uppermost one in accordance with the rotation of a pickup roller incorporated in the apparatus. The backup plate is urged upward by a spring member, thereby pressing the uppermost medium member against the pickup roller. The pickup roller has its surface coated with a rubber member and hence has a frictional force.

Since the sheets of the medium stacked on the backup plate have substantially the same frictional force, it is possible that other sheets placed under the uppermost one in contact therewith will be picked up simultaneously with the uppermost one during the rotation of the pickup roller. To avoid this, a separating mechanism is provided on the medium-picking side of the pickup roller for separating the sheets of the medium from each other. The separating mechanism includes a forwarding roller and an interrupting roller opposed to the forwarding roller. The forwarding roller and the pickup roller are synchronous with each other and rotate in the same direction. The interrupting roller is fixedly opposed to the forwarding roller, with a gap corresponding to one sheet interposed therebetween.

When a plurality of sheets of the medium in a stacked state have been picked up by the pickup roller, only the uppermost one passes through the gap between the forwarding roller and the interrupting roller, while the remaining sheets of the medium are interrupted by the interrupting roller. Further, each sheet of the medium forwarded in accordance with the rotation of the forwarding roller is sensed by a sensor, and the rotation of the pickup roller is stopped depending upon the sensing result. After each sheet of the medium passes the sensor, the sensor determines that each sheet has been sent to a later process, thereby rotating the pickup roller to pick up the next sheet of the medium.

Medium feeding apparatuses constructed as above are widely used for various purposes. Accordingly, these apparatuses treat various types of mediums that have different thicknesses or friction factors, or may be easily worn or deformed.

In light of the above, an apparatus is demanded which can reliably pick up and transfer various types of mediums one by one, and at the same time can execute a high-speed operation or can deal with a great amount of mediums.

However, in the prior art, each medium is pressed with a great force of, for example, about 1–5 N in light of, for example, deformation of each medium. This force is much higher than that necessary for forwarding mediums.

In general, when forwarding stacked sheets of a medium using a frictional force, the greater the force applied to each sheet to press it against the pickup roller, the larger the number of sheets to be forwarded simultaneously. Therefore, it is necessary to minimize the pressing force applied to each sheet. If, however, the pressing force is too small, slippage may occur between each sheet and the pickup roller. To avoid this, the pressing force applied to a medium is set at a high value in the prior art. As a result, it is possible that a plurality of sheets of a medium are simultaneously picked up by the pickup roller, thereby increasing the load on the separating mechanism that separates sheets of a medium from each other. In other words, the separating mechanism may not separate the sheets reliably.

When the pickup roller simultaneously picks up a plurality of sheets of a medium, it is desirable that a dedicated sensor should promptly sense it to thereby stop the rotation of the pickup roller. However, there is no space between the pickup roller and the separating mechanism, and hence such a sensor cannot be provided. This being so, a plurality of sheets of a medium, if simultaneously picked up, cannot promptly be sensed and the pickup roller cannot be stopped.

Since in the prior art, the rotation of the pickup roller is stopped on the basis of a signal output from a sensor provided downstream of the separating mechanism, large portions of sheets of a medium have been forwarded when the rotation of the pickup roller has been stopped.

BRIEF SUMMARY OF THE INVENTION

The present invention has been developed in light of the above, and aims to provide a medium-feeding apparatus capable of reliably feeding sheets of a medium one by one while applying a small force to the sheets to press them against a pickup roller.

The present invention also aims to provide a rotating or pivoting apparatus capable of promptly sensing slippage if it occurs between the outer ring of a pickup roller and a to-be-treated object during rotation or pivoting of the outer ring, thereby controlling the rotation or the pivoting of the outer ring.

According to a first aspect of the invention, there is provided a rotating or pivoting apparatus comprising:

- an inner ring rotating or pivoting when power is transmitted thereto from a driving source;
- an outer ring located outside the inner ring and rotating or pivoting when power is transmitted thereto from the inner ring, thereby transmitting power to a to-be-treated medium; and
- sensing means provided between the inner ring and the outer ring for sensing vibration of the outer ring to thereby sense slippage between the outer ring and the to-be-treated medium.

According to a second aspect of the invention, there is provided a medium feeding apparatus comprising:

- mounting means for mounting thereon a medium in a stacked manner;
- a pickup roller for picking up each of the medium while it rotates or pivots;
- a driving source for driving the pickup roller; and
- driving means for moving the mounting means to press the medium against the pickup roller;
- sensing means provided in the pickup roller for sensing a change in fine acceleration of the pickup roller to thereby sense slippage between the pickup roller and the medium; and
- control means for executing control so as to drive the driving means to thereby vary a force for pressing the medium against the pickup roller, when the sensing means has sensed slippage between the pickup roller and the medium.

According to a third aspect of the invention, there is provided a medium feeding apparatus comprising:

mounting means for mounting thereon a medium in a stacked manner;

a pickup roller for picking up each of the medium while it rotates or pivots;

a driving source for driving the pickup roller; and driving means for moving the mounting means to press the medium against the pickup roller;

sensing means provided in the pickup roller for sensing a change in fine acceleration of the pickup roller to thereby sense slippage between the pickup roller and the medium; and control means for executing control so as to drive the driving means to thereby vary a force for pressing the medium against the pickup roller, when the sensing means has sensed slippage between the pickup roller and the medium, wherein the pickup roller includes:

an inner ring rotating or pivoting when power is transmitted thereto from the driving source; and an outer ring located outside the inner ring and rotating or pivoting when power is transmitted thereto from the inner ring, thereby transmitting power to the medium, and the sensing means is provided between the inner ring and the outer ring for sensing a change in fine acceleration of the outer ring to thereby sense slippage between the outer ring and the medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Reference will now be made in detail to the presently preferred embodiments of the invention as illustrated in the accompanying drawings.

Figure 1:
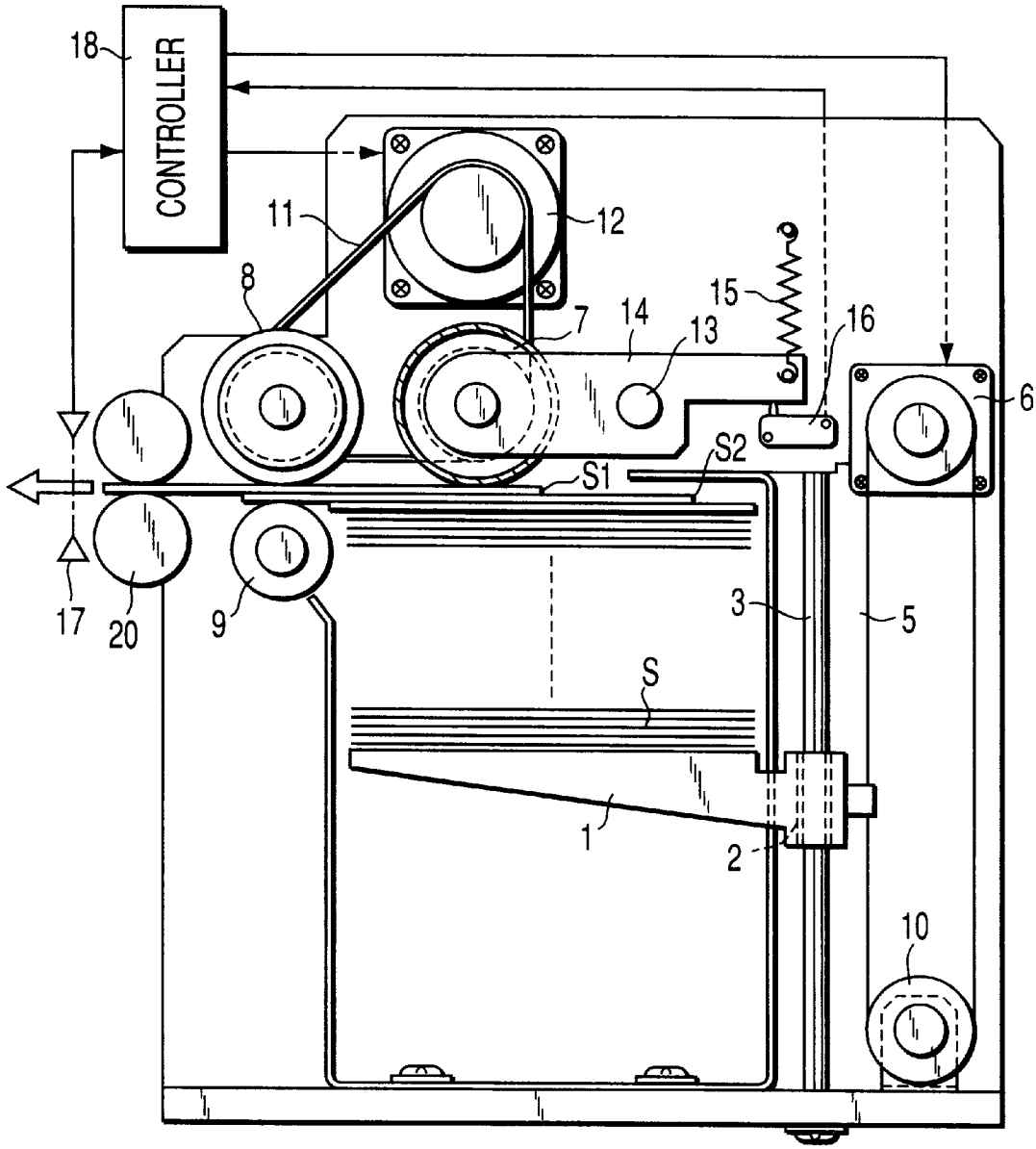
FIG. 1 is a view illustrating a medium pickup apparatus according to an embodiment of the invention.

FIG. 1 is a view illustrating a medium pickup apparatus according to an embodiment of the invention.

This medium pickup apparatus is applied to, for example, a copy machine, a printer, etc., for picking up a medium such as a copying sheet of paper.

In the figure, reference numeral 1 denotes a backup plate as mounting means for stacking, for example, sheets of a medium (to-be-treated objects) one on another. The backup plate 1 is vertically movably supported by a support shaft 3 via holder 2 containing a ball bearing. The holder 2 is coupled to a driving belt 5 constituting driving means, which connects a first driving motor 6 to a pulley 10.

A pickup roller 7 is provided above a medium S placed on the backup plate 1. A forwarding roller 8 constituting separating means is provided at the medium pickup side of the pickup roller 7. An interrupting roller 9 is opposed to the lower portion of the forwarding roller 8 with a gap corresponding to one sheet interposed therebetween. The interrupting roller is fixed so as not to rotate. When two or more sheets of the medium reach the forwarding roller 8 and the interrupting roller 9, these rollers allow only the uppermost one Sl of the sheets of the medium to pass therethrough, and prevents the second one S2 et seq. of them from passing.

The pickup roller 7 and the forwarding roller 8 are connected to a second driving motor 12 via a driving belt 11. These rollers 7 and 8 are made by the second driving motor 12 to rotate and stop in synchronism with each other.

The pickup roller 7 is attached to the front end of an attaching member 14, which has its middle portion rotatably supported by a support shaft 13. The rear end of the attaching member 14 is urged upward by a spring 15. When the pickup roller 7 has been pressed upward as described later to thereby rotate the attaching member 14 clockwise against the urging force of the spring 15, a micro switch 16 located behind the attaching member 14 is turned on.

A sensor 17 for optically sensing separately-forwarded-sheets is provided at the medium forwarding side of the forwarding roller 8. The sensor 17 and the micro switch 16 are connected to a controller 18 as control means via a signal line. The controller 18 is also connected, via a control circuit, to the first driving motor 6 for vertically moving the backup plate, and to the second driving motor 12 for rotating the pickup roller 7 and the forwarding roller 8.

A pair of transfer rollers 20 to be continuously rotated by a driving motor (not shown) is provided between the separating mechanism and the sensor 17. The transfer rollers 20 clamp each forwarded sheet and transfer it to the next process section.

Figure 2:
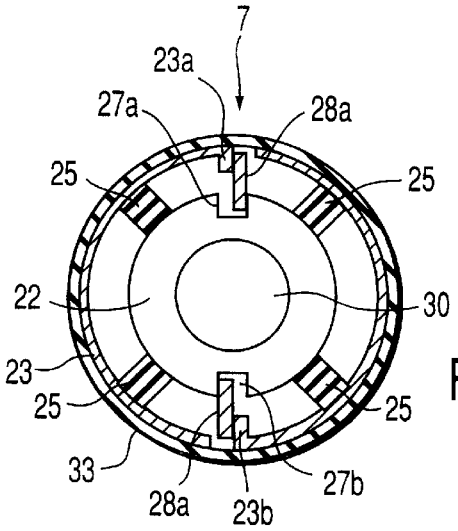
FIG. 2 is a sectional side elevation showing a pickup roller.
Figure 3:
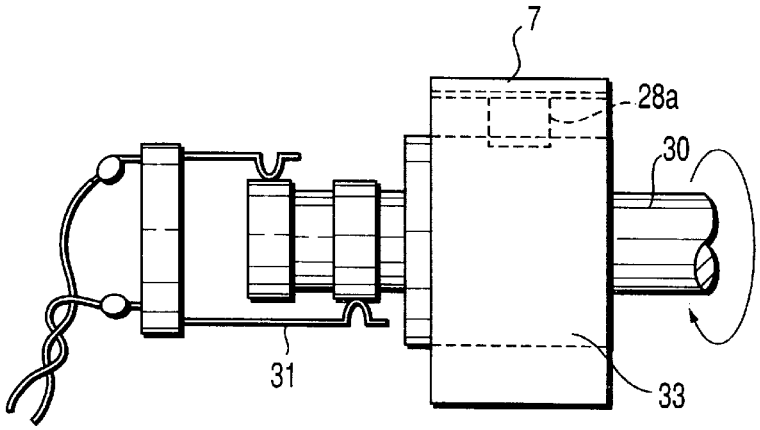
FIG. 3 is a front view showing the pickup roller.

FIG. 2 is a sectional side elevation of the pickup roller 7, and FIG. 3 is its front view.

The pickup roller 7 includes an inner ring 22 and an outer ring 23 located outside the inner ring 22. The inner ring 22 is directly rotated by the second driving motor 12 via a shaft 30. The inner and outer rings 22 and 23 are connected to each other via elastic members 25. The outer ring 23 is coated with a thin rubber member 33 with a high friction factor so as to prevent slippage between the ring 23 and each sheet S.

Grooves 27*a* and 27*b* are formed in the outer peripheral surface of the inner ring 22, in which one-end portions of piezoelectric elements 28*a* and 28*b* constituting sensing means are fitted, respectively. The other end portions of the piezoelectric elements 28*a* and 28*b* are engaged with bent portions 23*a* and 23*b*, respectively, which are formed by cutting and bending portions of the outer ring 23. The cable of the piezoelectric elements 28*a* and 28*b* is connected to the controller 18 via a slip ring 31 so that voltage signals output from the piezoelectric elements 28*a* and 28*b* can be transmitted to the controller 18 via the slip ring 31. When the outer ring 23 elastically connected to the inner ring 22 receives a rotational force, compression stress is applied to the piezoelectric elements 28*a* and 28*b*. As a result, voltages are generated by them.

Figure 4:
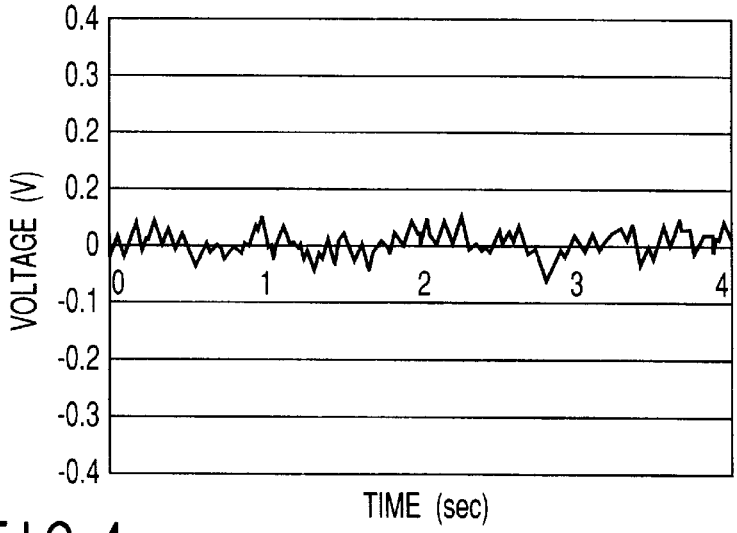
FIG. 4 is a graph illustrating a sensing signal output when no slippage occurs between the pickup roller and a medium.
Figure 5:
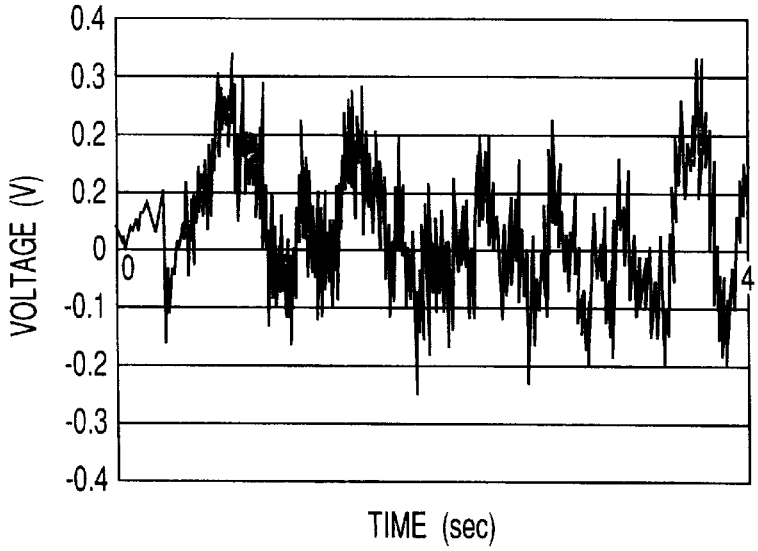
FIG. 5 is a graph illustrating a sensing signal output when slippage occurs between the pickup roller and the medium.

FIGS. 4 and 5 show signals output from the piezoelectric elements 28*a* and 28*b*.

Specifically, FIG. 4 shows a waveform obtained when a sheet S1 moves together with the pickup roller 7 without any slippage therebetween while the pickup roller 7 rotates. In this case, only a wave of undulations is generated.

FIG. 5 shows a waveform obtained when slippage has occurred between a sheet Si and the pickup roller 7 while the roller 7 rotates. In this case, a high frequency wave is superposed upon a wave of undulations.

In other words, FIG. 5 shows fluctuations in the fine force of stick slip due to slippage between the sheet SI and the rubber member 33 of the outer ring 23.

Figure 6:
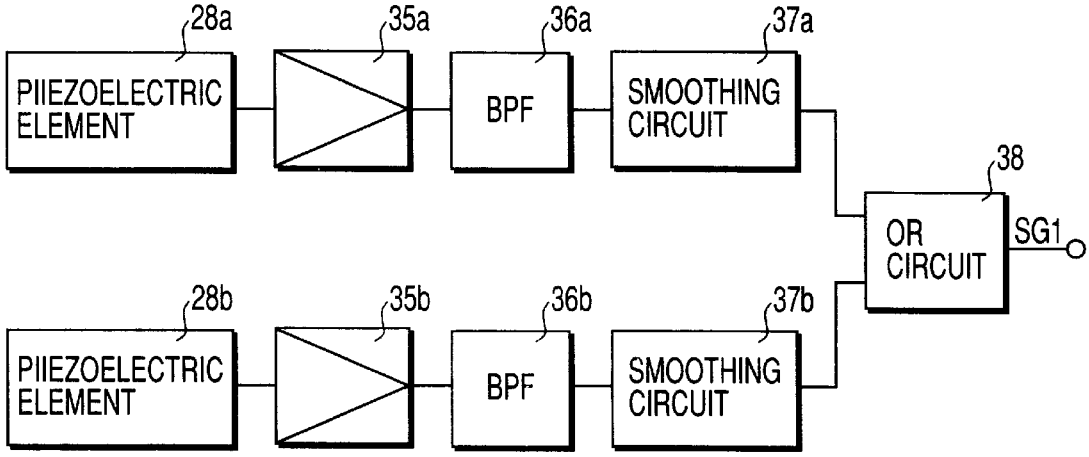
FIG. 6 is a block diagram showing a slippage sensing circuit for sensing slippage that occurs between the pickup roller and the medium.

FIG. 6 is a block diagram illustrating a sensing circuit for sensing slippage between the sheet S1 and the outer ring 23 of the pickup roller 7.

The piezoelectric elements 28*a* and 28*b* are connected to the controller 18 via amplifiers 35*a* and 35*b*, band-pass filters 36*a* and 36*b*, and smoothing circuits 37*a* and 37*b*, respectively, and also via an OR circuit 38. The band-pass filters 36*a* and 36*b* allow only a wave of 100–300 Hz to pass therethrough, i.e. only a wave output when slippage has occurred between the sheet S1 and the pickup roller 7 while the roller 7 rotates. Via this sensing circuit, a signal SG1 indicating that there is slippage, or a signal SG2 indicating that there is no slippage is supplied to the controller 18.

Figure 7:
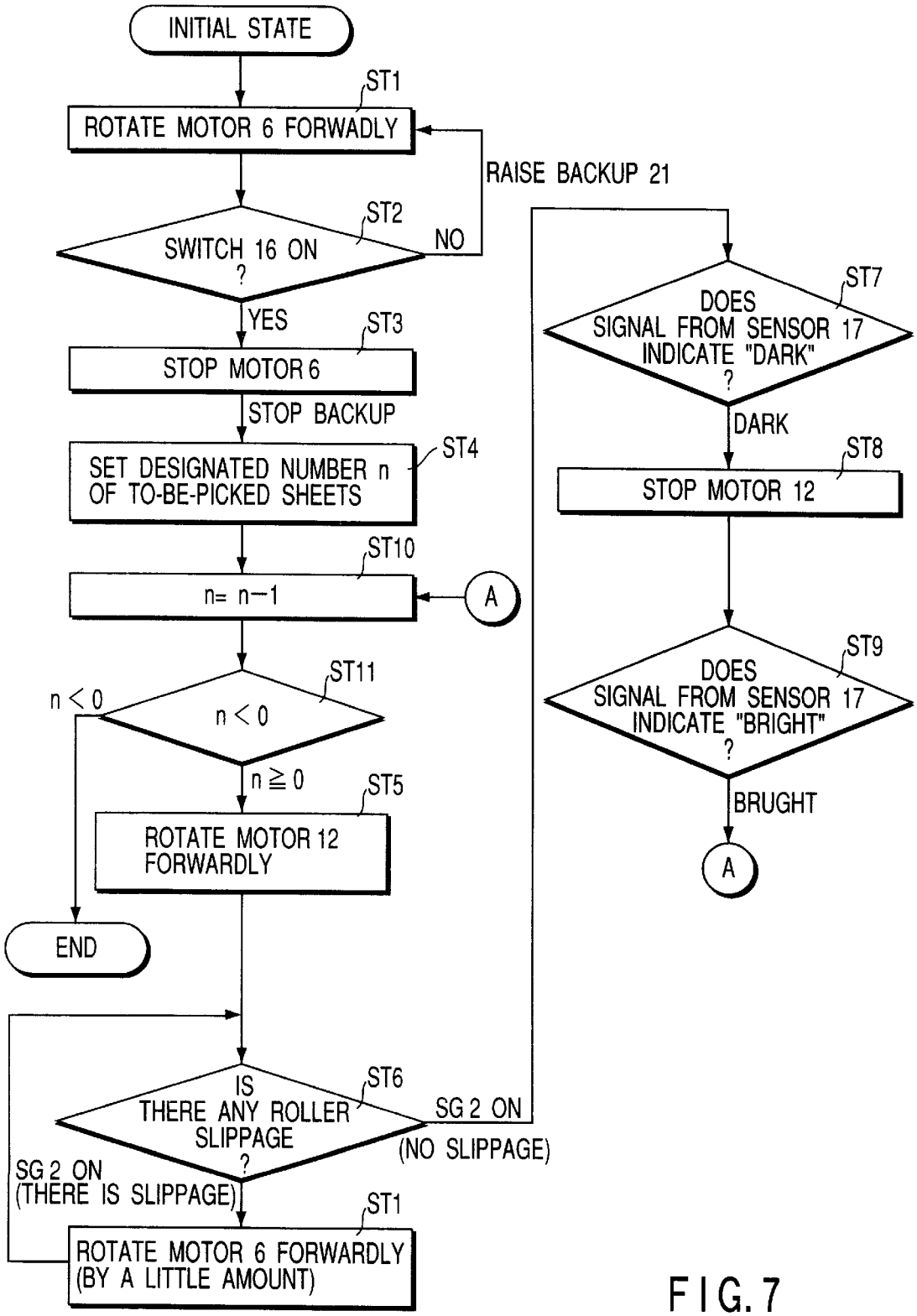
FIG. 7 is a flowchart useful in explaining an operation for taking out the medium.

Referring to the flowchart of FIG. 7, the operation of picking up each sheet will be described.

In the initial state, the backup plate 1 with a plurality of sheets S of a medium mounted thereon is situated in a lower position. Upon receiving an instruction to pick up each sheet, the controller 18 causes the first driving motor 6 to rotate forward (step ST1). As a result, the backup plate 1 is raised to press the uppermost sheet S1 against the pickup roller 7. Then, the attaching member 14 rotates clockwise against the urging force of the spring 15, thereby determining whether or not the micro-switch 16 is turned on by the rear end of the attaching member 14 (step ST2). If it is determined that the micro-switch 16 is turned on, the first driving motor 6 is stopped (step ST3). In this state, only a small force sufficient to compete with the total weight of the spring 15 and the roller system is applied to the pickup roller 7 and the uppermost sheet S1. In other words, the pickup roller 7 has only a small pickup force. Subsequently, the number of sheets to be picked up is designated (step ST4), thereby starting pickup of the sheets. Specifically, the second driving motor 12 is rotated forwardly (step ST5), thereby rotating the pickup roller 7. After that, it is determined whether or not slippage occurs between the pickup roller 7 and the sheet S1 (step ST6). If the signal SG2 indicating no slippage is obtained in the determination, which means that the sheet S1 has passed the sensor 17, it is determined whether or not a signal from the sensor 17 indicates "dark" (step ST7). If the signal from the sensor 17 indicates "dark", the rotation of the second driving motor 12 is stopped (step ST8), whereby the sheet S1 is transferred to the next process section in accordance with the rotation of the transfer rollers 20. Then, it is determined whether or not a signal indicating "bright" is output from the sensor 17 (step ST9). If the signal indicating "bright" is output therefrom, the next pickup operation is executed (step ST10). After that, it is determined whether or not the designated number n of sheets to be picked up is lower than 0 (step ST11). If the designated number n is lower than 0, the pickup operation is stopped, whereas if the designated number n is not lower than 0, the program returned to the step ST5.

If, on the other hand, the signal SG1 indicating the existence of slippage is detected at the step ST6, the first driving motor 6 is rotated by a small amount and stopped so as to slightly raise the backup plate 1 (step ST12). In this state, it is again determined whether or not there is slippage (step ST6). This loop is repeated until the signal ST2 indicating no slippage is output. By virtue of this processing, only a minimum frictional force necessary for preventing slippage is exerted between the pickup roller 7 and the sheet S1. If the signal SG2 indicating no slippage is output as a result of the above control, the program returns to the step ST7, where the same control as that performed after the output of the signal SG2 is executed.

Repeating the above-described control for a predetermined number of sheets enables feeding of the sheets one by one without strongly pressing the sheets against the pickup roller 7. Further, this processing enables realization of a feeding apparatus that can compensate a change in the frictional force between a medium and the pickup roller 7 due to abrasion of the roller or generation of paper particles.

Although the above-described embodiment relates to a medium feeding apparatus, the invention is not limited to it. The invention is applicable to any structure in which a rotary cylinder is brought into contact with a surface, and it is necessary to detect whether or not there is slippage between the cylinder and the surface when they contact each other.

Figure 8:
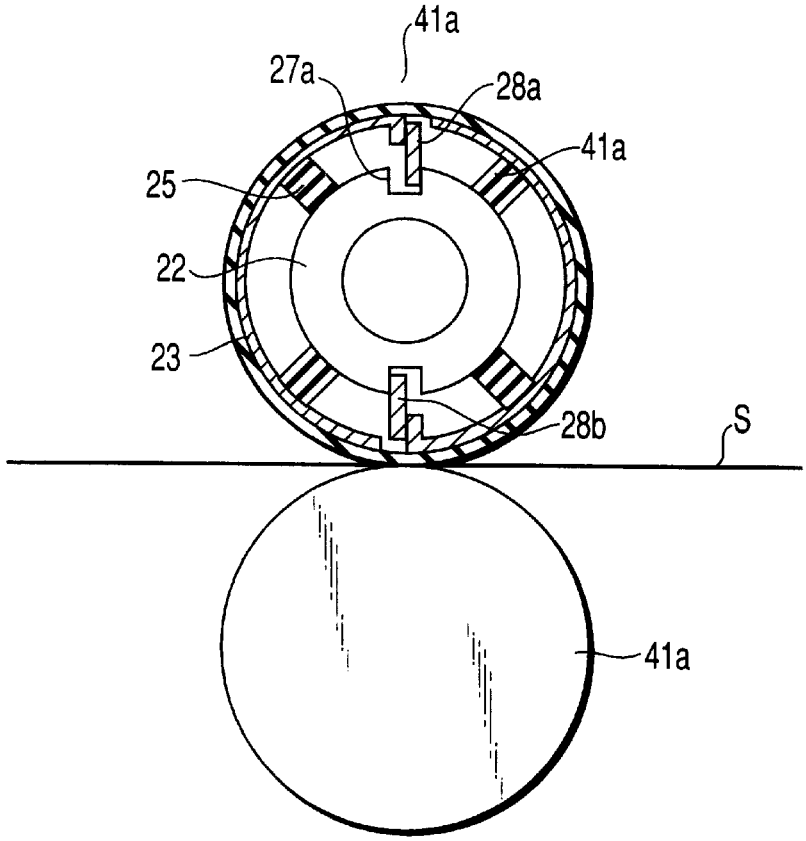
FIG. 8 is a sectional side elevation showing an example in which the pickup roller is used as a transfer roller.

For example, the invention is applicable to an ATM (Automated Teller Machine), an automated ticket machine, etc. In these machines, a medium S such as a bill, a bankbook, a card, a commuter pass, a ticket, etc. is clamped by a pair of transfer rollers 41*a* and 41*b* as shown in FIG. 8 and transferred. Further, slippage between the transfer roller 41*a* and the medium S is sensed.

Figure 9:
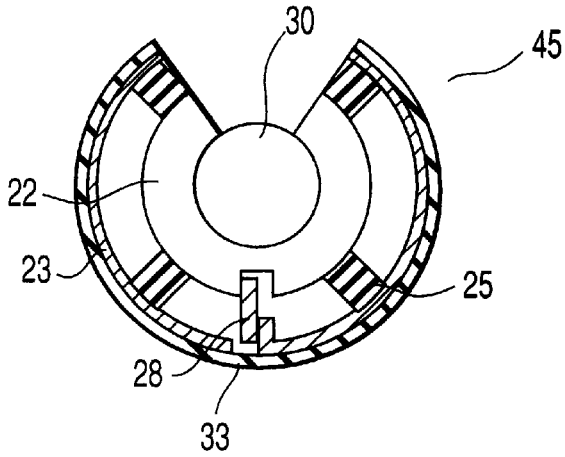
FIG. 9 is a sectional side elevation showing another example of the pickup roller.

Moreover, it is not always necessary to form the pickup roller completely cylindrical, but it suffices if the roller is substantially cylindrical. When, for example, picking up a medium by rotating the pickup roller through an angle less than 360 degrees, a pickup roller 45 as shown in FIG. 9 may be employed instead of the pickup roller 7, in which portions of the outer and inner rings 23 and 22 are cut out.

Figure 10:
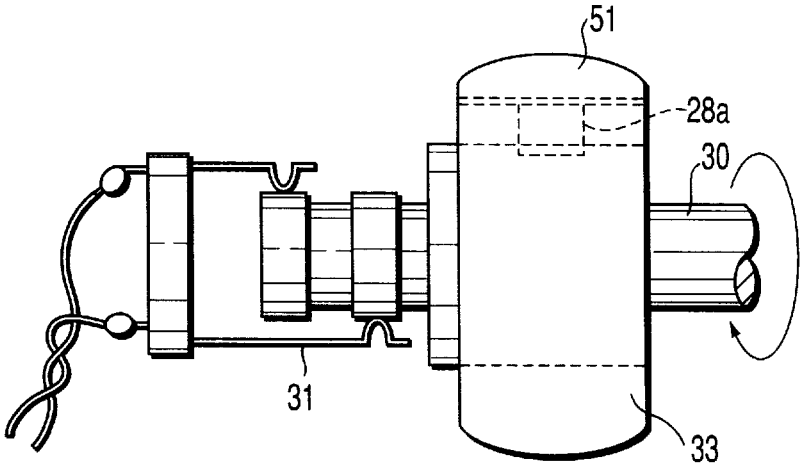
FIG. 10 is a front view showing yet another example of the pickup roller.

Furthermore, a pickup roller 51 of a shape called "crowning", as shown in FIG. 10, may be employed, in which a central portion of the cylinder is expanded like a drum.

In addition, although the above-described embodiment uses the piezoelectric elements 28*a* and 28*b* for detecting slippage between the pickup roller 7 and a medium S, a sensor for sensing a change in electrostatic capacity or a distortion gauge may be used in place of the piezoelectric elements. It suffices if the sensor can sense a fine acceleration due to stick slip on the outer surface of the pickup roller 7.

Although in the above embodiment, two piezoelectric elements 28*a* and 28*b* are fixed on respective portions of the outer ring 23, a single piezoelectric element may be provided on a single portion of the outer ring 23. Alternatively, more than two piezoelectric elements may be fixed on respective portions of the outer ring 23.

In other words, the number of piezoelectric elements relates to sensitivity for slippage, and is determined on the basis of the diameter or the rotational speed of the pickup roller 7.

Although the above embodiment uses the rubber member 33 with a high frictional factor as the coating member of the outer ring 23, the rubber member 33 has elasticity and hence is disadvantageous in that it absorbs a change in the fine acceleration of the outer ring 23. To minimize this disadvantage, the rubber member 33 is formed thin. A thick rubber member, however, can be used if it is devised so as not to absorb the fine acceleration change.

Further, since a signal indicating whether or not there is slippage between the pickup roller 7 and a medium is output from a rotating body, a device is necessary to transmit the signal to a stationary member. Although in the above embodiment, the slip ring 31 is used for transmitting the signal, a rotary transformer or radio transmission can be used instead of the slip ring.

Figure 11:
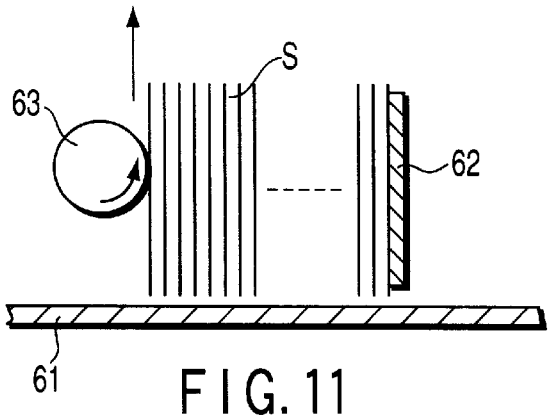
FIG. 11 is a schematic view showing a medium pickup apparatus according to another embodiment.

The pickup section for picking up a medium may have a structure as shown in FIG. 11.

In the embodiment of FIG. 11, stationary mounting means 61 is provided, and sheets of a medium S are stood up on the mounting means 61. A backup member 62 as horizontally movable pressing means presses the sheets against a pickup roller 63 to thereby pick up them.

Figure 12:
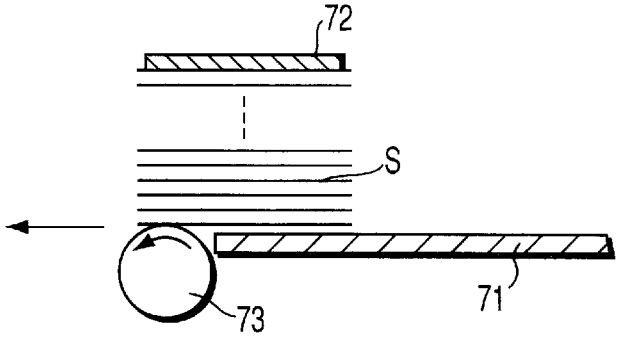
FIG. 12 is a schematic view showing a medium pickup apparatus according to a further embodiment.

The pickup section for picking up a medium may also have a structure as shown in FIG. 12.

In the embodiment of FIG. 12, stationary mounting means 71 is provided, and sheets of a medium S are stacked horizontally on the mounting means 71. A backup member 72 as vertically movable pressing means presses the sheets against a pickup roller 73 to thereby pick up them.

It is a matter of course that the present invention may be modified in various manners without departing from its scope.

As described above, in the invention, the piezoelectric elements 27*a* and 27*b* are provided between the inner and outer rings 22 and 23, and used to detect vibration of the outer ring 23 which occurs while it rotates to thereby detect slippage between the outer ring 23 and a medium S. Accordingly, when slippage has been detected therebetween, the rotation of the outer ring 23 can be instantly stopped or its rotational speed can be varied at once.

Moreover, in the invention, stacked sheets of a medium S are brought into contact with the pickup roller 7 by a relatively small force, and the force applied to the sheets to press them against the pickup roller 7 so as to pick up them one by one is varied when slippage occurs between the pickup roller 7 and the sheets. Accordingly, each sheet of the medium S can be picked up in a reliable manner without pressing the sheets against the pickup roller 7 by a great force.

Since it is not necessary to press the sheets of the medium S against the pickup roller 7 by a great force, the apparatus is also very advantageous in energy saving.

In addition, even if a frictional force generated between each sheet of the medium S and the pickup roller 7 varies as a result of abrasion of the roller, generation of paper particles, etc., a force to compensate it can be applied to the roller, thereby enabling reliable pickup of each sheet of the medium S.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotating or pivoting apparatus comprising:

an inner ring rotating or pivoting when power is transmitted thereto from a driving source;

an outer ring located outside the inner ring and rotating or pivoting when power is transmitted thereto from the inner ring, thereby transmitting power to a to-be-treated medium; and sensing means provided between the inner ring and the outer ring for sensing vibration of the outer ring to thereby sense slippage between the outer ring and the to-be-treated medium.

2. A rotating or pivoting apparatus according to claim 1, wherein the sensing means senses the frequency of the vibration of the outer ring to detect the slippage from the sensed frequency.

3. A rotating or pivoting apparatus according to claim 1, wherein the inner ring and the outer ring are formed of cylindrical members.

4. A rotating or pivoting apparatus according to claim 1, wherein the inner ring and the outer ring are formed of partially cut-out cylindrical members.

5. A rotating or pivoting apparatus according to claim 1, wherein the outer ring has an outer peripheral surface formed such that a substantially central portion is swollen in the shape of an arc.

6. A medium feeding apparatus comprising:

mounting means for mounting thereon a medium in a stacked manner;

a pickup roller for picking up each of the medium while it rotates or pivots;

a driving source for driving the pickup roller; and driving means for moving the mounting means to press the medium against the pickup roller;

sensing means provided in the pickup roller for sensing a change in fine acceleration of the pickup roller to thereby sense slippage between the pickup roller and the medium; and control means for executing control so as to drive the driving means to thereby vary a force for pressing the medium against the pickup roller, when the sensing means has sensed slippage between the pickup roller and the medium.

7. A medium feeding apparatus according to claim 6, wherein the control means repeats the control for varying the force to press the medium against the pickup roller, until the sensing means does not sense any more slippage between the pickup roller and the medium.

8. A medium feeding apparatus according to claim 6, further comprising separating means for separating, one by one, the medium picked up by the pickup roller.

9. A medium feeding apparatus comprising:

mounting means for mounting thereon a medium in a stacked manner;

a pickup roller for picking up each of the medium while it rotates or pivots;

a driving source for driving the pickup roller; and driving means for moving the mounting means to press the medium against the pickup roller;

sensing means provided in the pickup roller for sensing a change in fine acceleration of the pickup roller to thereby sense slippage between the pickup roller and the medium; and control means for executing control so as to drive the driving means to thereby vary a force for pressing the medium against the pickup roller, when the sensing means has sensed slippage between the pickup roller and the medium, wherein the pickup roller includes:

an inner ring rotating or pivoting when power is transmitted thereto from the driving source; and an outer ring located outside the inner ring and rotating or pivoting when power is transmitted thereto from the inner ring, thereby transmitting power to the medium, and the sensing means is provided between the inner ring and the outer ring for sensing a change in fine acceleration of the outer ring to thereby sense slippage between the outer ring and the medium.

10. A medium feeding apparatus according to claim 9, wherein the control means repeats the control for varying the force to press the medium against the pickup roller, until the sensing means does not sense any more slippage between the pickup roller and the medium.

11. A medium feeding apparatus according to claim 9, further comprising separating means for separating, one by one, the medium picked up by the pickup roller.

* * * * *